US010646886B2

(12) United States Patent
Bobusch et al.

(10) Patent No.: US 10,646,886 B2
(45) Date of Patent: May 12, 2020

(54) FLUIDIC OSCILLATOR AND APPLICATIONS OF THE FLUIDIC OSCILLATOR

(71) Applicant: FDX Fluid Dynamix GmbH, Berlin (DE)

(72) Inventors: Bernhard Bobusch, Berlin (DE); Oliver Krüger, Berlin (DE); Jens Wintering, Berlin (DE)

(73) Assignee: FDX Fluid Dynamix GmbH, Berlin (DE)

( * ) Notice: Subject to any disclaimer, the term of this patent is extended or adjusted under 35 U.S.C. 154(b) by 225 days.

(21) Appl. No.: 15/580,324

(22) PCT Filed: Jun. 8, 2016

(86) PCT No.: PCT/EP2016/063029
§ 371 (c)(1),
(2) Date: Dec. 7, 2017

(87) PCT Pub. No.: WO2016/198449
PCT Pub. Date: Dec. 15, 2016

(65) Prior Publication Data

US 2018/0161786 A1 Jun. 14, 2018

(30) Foreign Application Priority Data

Jun. 8, 2015 (DE) ..... 10 2015 108 971

(51) Int. Cl.
*B05B 1/08* (2006.01)
*B05B 15/40* (2018.01)
*F15C 1/22* (2006.01)

(52) U.S. Cl.
CPC ..... *B05B 1/08* (2013.01); *B05B 15/40* (2018.02); *F15C 1/22* (2013.01)

(58) Field of Classification Search
CPC ... B05B 1/08; B05B 15/40; F15C 1/22; F15B 21/12
(Continued)

(56) References Cited

U.S. PATENT DOCUMENTS 3,185,166 A * 5/1965 Horton ..... F15C 1/08 137/835
3,690,171 A 9/1972 Tippetts et al.
(Continued)

FOREIGN PATENT DOCUMENTS

CN 2525791 Y 12/2002
CN 101094723 A 12/2007
(Continued)

OTHER PUBLICATIONS

Bobusch et al., "Experimental study of the internal flow structures inside a fluidic oscillator", Experiments in Fluids, 2013, vol. 54:1559, pp. 1-12.
(Continued)

*Primary Examiner* — Darren W Gorman
(74) *Attorney, Agent, or Firm* — The Webb Law Firm

(57) ABSTRACT

A fluidic component includes a flow chamber with at least one inlet opening and at least one outlet opening. The flow chamber can be traversed by a main flow of a fluid from the at least one inlet opening to the at least one outlet opening and includes at least one deflection device for the targeted change in direction of the main flow, in particular a periodic reversal of the main flow. The fluidic component includes at least one filter element between the deflection device for the targeted change in direction of the main flow and the flow chamber, in particular a deflection device for generating a varying approach flow direction for the main flow. The at least one filter element is not arranged upstream of the flow chamber or at the inlet opening of the flow chamber.

17 Claims, 12 Drawing Sheets

(58) Field of Classification Search
USPC ..... 239/589.1, 590
See application file for complete search history.

(56) References Cited

U.S. PATENT DOCUMENTS

| | | | | |
|---|---|---|---|---|
| 3,902,367 | A | 9/1975 | Grant et al. | |
| 4,508,267 | A * | 4/1985 | Stouffer | B05B 1/08 137/835 |
| 8,091,434 | B2 | 1/2012 | Vaidya | |
| 8,733,401 | B2 | 5/2014 | Schultz et al. | |
| 2001/0019086 | A1 | 9/2001 | Srinath et al. | |
| 2003/0009188 | A1* | 1/2003 | Linder | A61F 2/013 606/194 |
| 2003/0127142 | A1* | 7/2003 | Stouffer | B05B 1/08 137/803 |
| 2003/0234303 | A1 | 12/2003 | Berning et al. | |
| 2006/0226266 | A1* | 10/2006 | Russell | B05B 1/08 239/589.1 |
| 2006/0243823 | A1 | 11/2006 | Bachmann et al. | |
| 2010/0276521 | A1 | 11/2010 | Gopalan | |
| 2011/0061692 | A1* | 3/2011 | Gopalan | B05B 1/08 134/169 R |
| 2018/0078952 | A1* | 3/2018 | Russell | B05B 1/08 |

FOREIGN PATENT DOCUMENTS

| | | | |
|---|---|---|---|
| CN | 103028516 | A | 4/2013 |
| DE | 2051804 | A1 | 5/1971 |
| DE | 2414970 | A1 | 10/1974 |
| DE | 102015222771 | B3 | 5/2017 |
| EP | 1513711 | B1 | 6/2007 |
| EP | 1658209 | B1 | 2/2008 |
| EP | 2101922 | B1 | 10/2010 |
| EP | 1827703 | B1 | 8/2012 |
| WO | 8000927 | A1 | 5/1980 |
| WO | 0033965 | A1 | 6/2000 |
| WO | 2017085129 | A1 | 5/2017 |

OTHER PUBLICATIONS

Campagnuolo et al., "Review of Some Fluid Oscillators", 1996, US Army Material Command, Harry Diamond Laboratories, Washington DC, pp. 1-54.

Gregory et al., "A Review of Fluidic Oscillator Development and Application for Flow Control", 43rd Fluid Dynamics Conference, 2013, San Diego, CA, pp. 1-17.

* cited by examiner

FLUIDIC OSCILLATOR AND APPLICATIONS OF THE FLUIDIC OSCILLATOR

CROSS REFERENCE TO RELATED APPLICATIONS

This application is the United States national phase of International Application No. PCT/EP2016/063029 filed Jun. 8, 2016, and claims priority to German Patent Application No. 10 2015 108 971.8 filed Jun. 8, 2015, the disclosures of which are hereby incorporated in their entirety by reference.

BACKGROUND OF THE INVENTION

Field of the Invention

This invention relates to a fluidic component and to apparatuses which comprise such fluidic component.

Description of Related Art

This invention relates to a fluidic component according to the preamble of claim 1 and to apparatuses which comprise such fluidic component.

Fluidic components are provided to produce a moving fluid jet. At the component outlet a desired fluid flow pattern is produced, without the fluidic component comprising any movable elements. Examples for such fluid flow patterns include jet oscillations, rectangular, sawtooth-shaped or triangular jet paths, spatial or temporal jet pulsations and switching operations. Oscillating fluid jets are used to for example uniformly distribute a fluid jet (or fluid stream) on a target area. The fluid stream can be a liquid stream, a gas stream or a multi-phase stream (for example wet steam).

Fluidic components are known for example from U.S. Pat. Nos. 8,702,020 B2 or 8,733,401 B2. These components include a flow chamber which can be traversed by a main flow of a fluid. The flow chamber also is referred to as interaction chamber.

The flow chamber includes at least one inlet opening, via which the fluid enters into the fluidic component, and at least one outlet opening, via which the fluid exits from the fluidic component. For an oscillating fluid deflection at the outlet opening of the fluidic component a means for the targeted change in direction of the fluid stream is provided. In the fluidic components from U.S. Pat. Nos. 8,702,020 B2 and 8,733,401 B2 this means is formed as at least one additional flow channel (also referred to as feedback channel). This feedback channel is a means for reversing a main flow, which traverses the flow chamber from the inlet opening to the outlet opening. The means for the targeted change in direction also can be formed as a closed cavity. Note that the means for the targeted change in direction of the main flow may also be referred to as a deflection device for the targeted change in the direction of the main flow.

When the fluidic component is traversed by a particle-containing fluid, the particles (for example foreign objects or impurities) can accumulate in portions of the fluidic component, so that the fluidic component no longer can perform its function or only in a deteriorated way. To avoid such accumulation of particles in a fluidic component, it is known from the prior art to either insert separate filter elements upstream of the inlet opening of the fluidic component for shielding against foreign objects or to use integrated filter elements directly at the inlet opening of the fluidic component. The particle-containing fluid thus flows around (passes) the filter elements, which are located upstream of or at the inlet opening of the fluidic component and filter out the particles before entry of the fluid into the fluidic component.

The use of additional means for fluid filtration upstream of the inlet opening on the one hand causes higher costs than a fluidic component without filter elements and on the other hand increases the complexity of the systems. When the filter elements are arranged at the inlet opening of the fluidic component (as known for example from EP 1 513 711 B1, EP 1 053 059 B1 or EP 1 827 703 B1), the fluidic component can lose its function when the filter element is clogged due to foreign objects. In such components or due to additional means for fluid filtration arranged upstream of the inlet opening, the pressure loss also is increased as compared to a fluidic component without filter elements.

SUMMARY OF THE INVENTION

It is an object underlying the present invention to create a fluidic component which in particular is robust with respect to contaminations by particles or foreign objects from a fluid containing particles or foreign objects.

According to the invention, this object is solved by a fluidic component with features as described herein.

Accordingly, the fluidic component comprises a flow chamber with at least one inlet opening and at least one outlet opening, wherein the flow chamber can be traversed by a main flow of a fluid from the at least one inlet opening to the at least one outlet opening. The main flow thus has a basic direction which is directed from the at least one inlet opening to the at least one outlet opening. The fluidic component furthermore comprises at least one means for the targeted change in direction of the main flow. The means for the targeted change in direction in particular can be a means for periodically reversing the main flow. The fluidic component is characterized in that at least one filter element is provided, which is arranged between the means for the targeted change in direction of the main flow and the flow chamber. In particular, the at least one filter element can be arranged between a means for generating a varying approach flow direction for the main flow and the flow chamber. The means for the targeted change in direction of the main flow hence can be a means for generating a varying approach flow direction for the main flow.

The at least one filter element hence is not arranged upstream of or at the inlet opening of the fluidic component, so that only a part of the fluid stream (namely the secondary flow as will be explained later on) passes the at least one filter element. In this way, a strong pressure drop due to the presence of the at least one filter element can be avoided. The at least one filter element does not generally prevent that particles get into the fluidic component. However, the at least one filter element can prevent/impede that particles get into the means for the targeted change in direction of the main flow. In particular when the means for the targeted change in direction of the main flow has a smaller inside diameter than the flow chamber can it be avoided by the at least one filter element, which is arranged between the means for the targeted change in direction of the main flow and the flow chamber, that particles deposit/accumulate in the means for the targeted change in direction of the main flow and hence impair the function of this means such that the fluid stream no longer exits from the outlet opening of the fluidic component as moving fluid stream.

For preserving the function of the fluidic component, which is traversed by a particle-containing fluid, a filter function is sufficient for the means for the targeted change in direction of the main flow. Accordingly, it is not required that the entire fluid stream passes the at least one filter element. This probably has not been realized so far, as it has been assumed that the function of the fluidic components thereby would be influenced too much. Perhaps it has been assumed that the additional filter elements involve an increase of the surface area, and thus the risk of faster smearing or calcification of the fluidic components is increased.

In the region between the means for the targeted change in direction of the main flow and the flow chamber a secondary flow branches off from the main flow, wherein the secondary flow and the main flow can flow in different directions. While the main flow traverses the flow chamber, the secondary flow traverses the means for the targeted change in direction of the main flow. Particles which by the secondary flow are directed to the at least one filter element and accumulate there can be entrained by the main flow and leave the fluidic component through the outlet opening. It can thus be avoided that the at least one filter element is clogged by an accumulation of particles and hence the function of the means for the targeted change in direction of the main flow is impaired such that the fluid stream no longer exits at the outlet opening of the fluidic component as moving (oscillating) fluid stream.

The at least one filter element in particular can be arranged between the flow chamber and the at least one means for the targeted change in direction of the main flow such that in operation (i.e. while a fluid stream flows through the fluidic component) the at least one filter element is exposed to a flow with changing flow direction. This flow in particular can be the main flow, which oscillates due to the means for the targeted change in direction of the main flow. Due to the changing flow direction, flushing of the at least one filter element can be achieved. In operation, the at least one filter element hence is subject to a self-cleaning effect.

Preferably, the at least one filter element can be arranged along or parallel to one of the streamlines of the main flow. In addition, the alignment along such streamlines, which are disposed in the edge region of the main flow (close to the wall), can be provided when the main flow is pressed or adheres to a side wall of the flow chamber. An edge region of the main flow close to the wall is understood to be a region of the main flow which is located closer to a side wall of the flow chamber than an axis which extends centrally through the flow chamber along the basic direction of the main flow.

The at least one filter element also can be arranged in a region along or parallel to a streamline of the main flow, in which as compared to other streamlines or regions the main flow at least temporarily has a large (or the largest) flow velocity component substantially vertical to the basic direction of the main flow (which is defined from the inlet opening to the outlet opening of the fluidic component). Such region for example is a region in which temporarily a recirculation area is formed (due to the means for the targeted change in direction of the main flow), which has two flow velocity components substantially vertical to the basic direction of the main flow, wherein the one component is directed to the at least one filter element and the other component is directed away from the at least one filter element. An accumulation of particles thereby can be released from the at least one filter element.

The at least one filter element also can be arranged in a region along or parallel to a streamline of the main flow, in which as compared to other streamlines or regions the main flow at least temporarily has a large (or the largest) flow velocity component substantially along the basic direction of the main flow. Such region for example is a region in which the main flow temporarily flows from the inlet opening to the outlet opening of the fluidic component. The particles released from the at least one filter element thereby can be transported to the outlet opening of the fluidic component.

The term temporarily is to be understood to the effect that a flow velocity component only is present for a limited period, which for example lies in a range of some milliseconds.

Preferably, the at least one filter element can be arranged in a region (between the at least one filter element and the means for the targeted change in direction of the main flow), in which for a first period the main flow has a large (or the largest) flow velocity component substantially vertical to the basic direction of the main flow as compared to other regions and for a second period has a large (or the largest) flow velocity component substantially along the basic direction of the main flow as compared to other regions. The first and the second period can alternate (repeatedly one after the other). The skilled person can determine this region by means of the usual methods known from the prior art for a fluidic component without filter elements.

The larger a first velocity component, which extends (substantially) vertically to the main flow, the better the cleaning effect can be for the at least one filter element. This effect can be intensified for the at least one filter element by a second (temporally offset) velocity component with the largest vibration amplitude, which extends (substantially) along the main flow, as this at least one filter element thus is constantly rinsed from different directions. Due to the high vibration amplitude of the first and the second velocity component, disturbing particles are transported in direction of the main flow and removed from the component with the main flow.

The at least one filter element can also be arranged at a position (in a region) between the flow chamber and the at least one means for the targeted change in direction of the main flow, at which the absolute change in flow velocity (transversely to the basic direction of the main flow) changes maximally. The maximum can be a local or a global maximum. Furthermore, the at least one filter element can also be arranged at a position (in a region) between the flow chamber and the at least one means for the targeted change in direction of the main flow, at which the cross-section of the flow chamber or of the means for the targeted change in direction of the main flow, which is effective for the flow, is minimal. This can be a local or global minimum. In the case of a wrong positioning of the at least one filter element, on the other hand, the fluidic component can lose its function.

According to one embodiment, the at least one means for the targeted change in direction of the main flow can include one or more feedback channels, be formed as feedback channel or be formed as closed cavity. The feedback channel or the closed cavity are in fluid connection with the flow chamber. For this purpose, the feedback channel has an inlet and an outlet with one opening each. The closed cavity on the other hand has an opening which forms both the inlet and the outlet.

According to one embodiment the at least one filter element can be arranged at an opening of the at least one means for the targeted change in direction of the main flow (of the at least one feedback channel or the closed cavity). In particular, the at least one filter element can be arranged only at the inlet, only at the outlet or at the inlet and at the outlet of the at least one means for the targeted change in direction of the main flow. For example, the at least one filter element can be arranged only at the inlet, only at the outlet or at the inlet and at the outlet of the feedback channel. In the case where at least one filter element is provided both at the inlet and at the outlet of the feedback channel, the filter elements can differ from each other such that the at least one inlet-side filter element reduces the opening of the feedback channel at the inlet more strongly than the at least one outlet-side filter element reduces the opening of the feedback channel at the outlet.

For example, the at least one filter element can be formed cylindrical, pyramid-shaped or conical or have a rectangular, triangular, oval, round or polygonal cross-section. By choosing the shape, the size, the number and the arrangement density of the filter elements, the reduction of the cross-section of the respective opening (of the feedback channel or the closed cavity) can be adjusted. These parameters can be chosen for example in dependence on the type of the fluid as well as the quantity, shape and size of the particles with which the fluid is loaded. Several filter elements can be lined up in a filter element assembly, wherein a distance each is provided between the individual filter elements and the filter elements are lined up. The filter elements can extend along a straight line, follow a curvature or have any other course. The course can depend on the geometry of the fluidic component, the type of the fluid (for example viscosity, density, surface tension, temperature) and/or the type of the particles (for example size, shape, deformability). The exact position of the filter elements in the region of the feedback channels or closed cavity can be varied.

According to one embodiment the filter element assembly in a mental continuation of the laterally delimiting walls of the fluidic component (of the flow chamber) is effected at a position between the flow chamber and the at least one means for the targeted change in direction of the main flow.

The filter element can extend over the entire component depth. The component depth is defined substantially vertically to the plane in which the exiting fluid stream oscillates. The filter elements can be arranged at a distance from side walls of the flow chamber and the means for the targeted change in direction of the main flow. There can be provided a filter element assembly (a group of filter elements) which for example extends across the entire (or a part of the) width of an opening of the means for the targeted change in direction of the fluid stream. The filter element assemblies extend substantially transversely (which does not necessarily mean an angle of 90°) to the flow direction of the secondary flows. In feedback channels filter elements or filter element assemblies can be chosen such that the cross-section of the feedback channel is reduced more strongly at its inlet than the cross-section of the feedback channel at its outlet. For example, the distance between filter elements in the inlet region can be smaller than the distance between filter elements in the outlet region. In feedback channels, filter elements also can be provided only in the inlet region (and not in the outlet region).

Alternatively, the at least one filter element can have a lattice structure and/or a net structure. This structure can extend over the entire opening at the inlet/outlet of the feedback channel or of the closed cavity and thereby retain the particles like a sieve. By choosing the density and the thickness of the lattice or net lines of the at least one filter element, the reduction of the size of the respective opening can be adjusted.

Depending on the exact positioning between the flow chamber and the means for the targeted change in direction of the main flow (in the inlet or outlet region of the means) the at least one filter element can influence the function of the fluidic component and hence the course of the fluid at the outlet opening of the fluidic component. The filter elements can change the exit angle and/or the oscillation frequency of the exiting fluid jet as compared to a fluidic component without filter elements. By choosing the geometry parameters of the at least one filter element, or of the filter element assembly, and/or of the fluidic component the changes in the frequency and/or exit angle of the fluid stream, which can be caused by the filter elements at the outlet opening of the fluidic component, can be diminished or eliminated. The filter elements can also actively be employed for influencing the exiting fluid stream. The radiation characteristic, e.g. the exit angle of the fluid jet or the frequency, hence can be influenced in a targeted way.

According to another embodiment, a non-stick coating can be provided, which prevents/impedes the deposition of particles or facilitates flushing away of the particles. This non-stick coating in particular can be applied on the at least one filter element. Alternatively or in addition, the non-stick coating also can be applied on the inner surface of the flow chamber and/or of the means for the targeted change in direction of the main flow.

According to another embodiment, the at least one filter element can be formed as rigid body. Alternatively, the at least one filter element can at least partly be formed flexible and/or elastically deformable.

Fluidic components according to at least one embodiment of the invention can be used in various devices, in particular household appliances, industrial appliances or commercial appliances. Such devices include for example rinsing machines, dishwashing appliances, washing machines, steam cleaning appliances, steam cookers, convection ovens, pasteurizing systems, tumble dryers, appliances with steam function, sterilizing systems, disinfection systems. Even in cleaning appliances, in particular in the wet cleaning process technology, such as for example in high-pressure cleaners, low-pressure cleaners, washing lines, spray cleaning systems, descaling systems, de-icing systems, the fluidic component according to the invention can be used.

Furthermore, irrigation devices for example in agriculture and agricultural technology, devices for distributing plant protection agents, blasting technology devices (devices for generating ball jets which are used in the so-called shot peening, devices for generating $CO_2$, snow or dry ice jets, blasting with mineral media, compressed-air blasting), surface treatment devices in painting facilities and in electroplating facilities, whirlpools, mixing systems (combustion devices, internal combustion engines, heating systems, injection systems, mixing facilities, bio/chemical reactors), cooling systems, extinguishing systems, in particular for facilities operating with river water, sea water or lake water, and water treatment systems are a potential field of application for the fluidic component according to the invention.

BRIEF DESCRIPTION OF THE DRAWING

The invention will be explained in detail below by means of several exemplary embodiments with reference to the Figures, in which.

DESCRIPTION OF THE INVENTION

Figure 1:
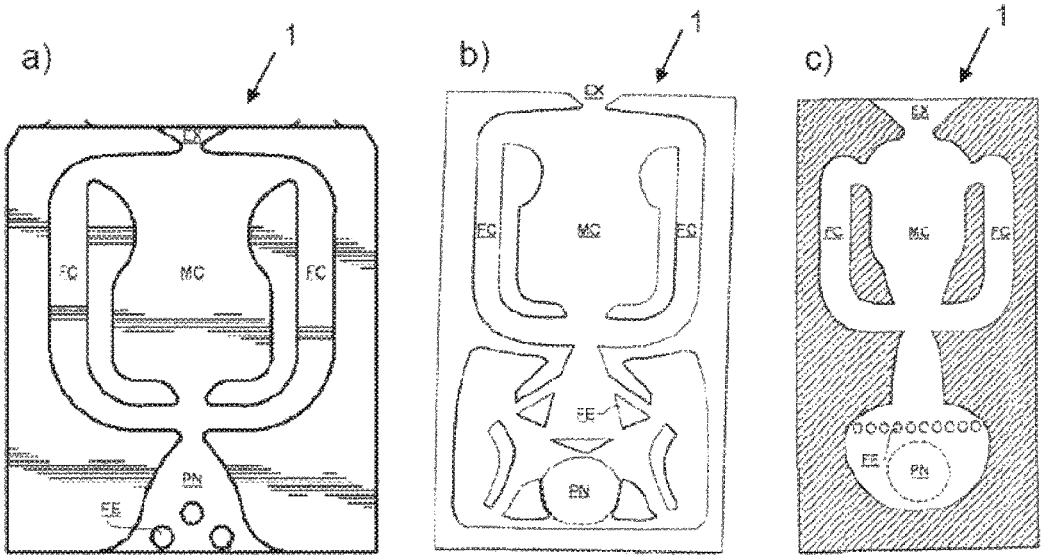
FIG. 1 PRIOR ART
FIG. 1 in the sub-images a), b) and c) schematically shows three known fluidic components with additional flow channels and integrated filter elements each in the region of the inlet opening of each fluidic component.
Figure 2:
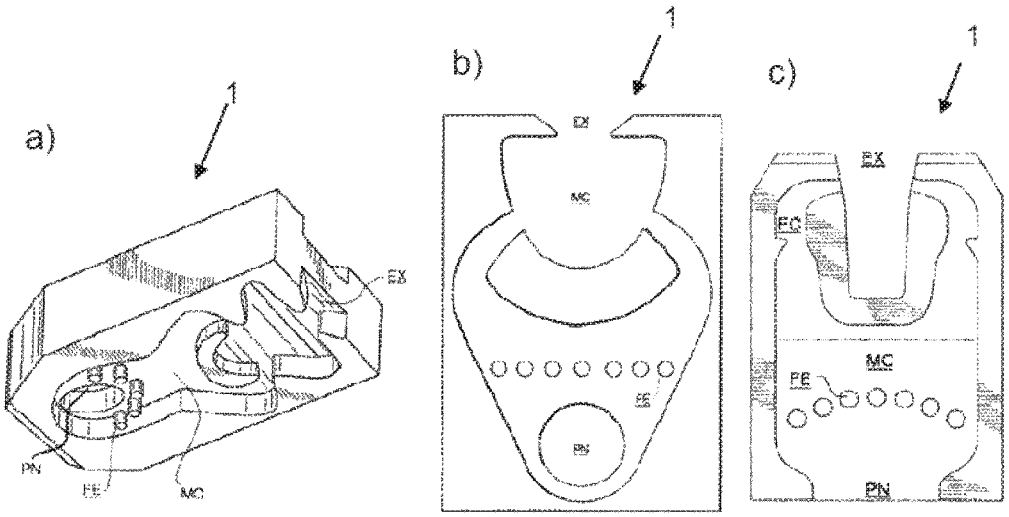
FIG. 2 PRIOR ART
FIG. 2 in the sub-images a), b) and c) schematically shows three known fluidic components with integrated filter elements each in the region of the inlet opening of each fluidic component.

FIGS. 1 and 2 show various fluidic components which are known from the prior art. The fluidic component of FIG. 1, sub-image a), is disclosed in U.S. Pat. No. 8,702,020 B2, the fluidic components of FIG. 1, sub-images b) and c), and of FIG. 2, sub-image b), in EP 1 053 059 B1, the fluidic component of FIG. 2, sub-image a), in EP 1 513 711 B1, and the fluidic component of FIG. 2, sub-image c), in EP 2 102 922 B1.

The fluidic components generally are designated with the reference numeral 1. The fluidic components 1 each include a flow chamber MC which can be traversed by a (particle-loaded) fluid. The fluid enters into the flow chamber MC via an inlet opening PN and again exits from the flow chamber MC via an outlet opening EX. The fluidic components 1 of FIG. 1 each include two feedback channels FC as means for the targeted change in direction of the main flow of the fluid stream. The fluidic components 1 of FIG. 2 each include two collision channels as means for the targeted change in direction of the main flow of the fluid stream, which are aligned with each other such that the streams exiting from the collision channels collide with each other, so as to generate an oscillation.

In the region of the inlet opening PN of the fluidic components 1 of FIGS. 1 and 2 filter elements FE each are arranged for filtering particles with which the fluid entering into the fluidic components 1 might be loaded. The filter elements FE have different shapes and arrangements. The fluidic components 1 of FIGS. 1 and 2, however, have in common that the filter elements FE always are arranged such that the entire fluid must pass the filter elements FE, in order to be able to reach the outlet opening.

In the following, various embodiments of the invention will be described with reference to FIGS. 3 to 19.

Figure 3:
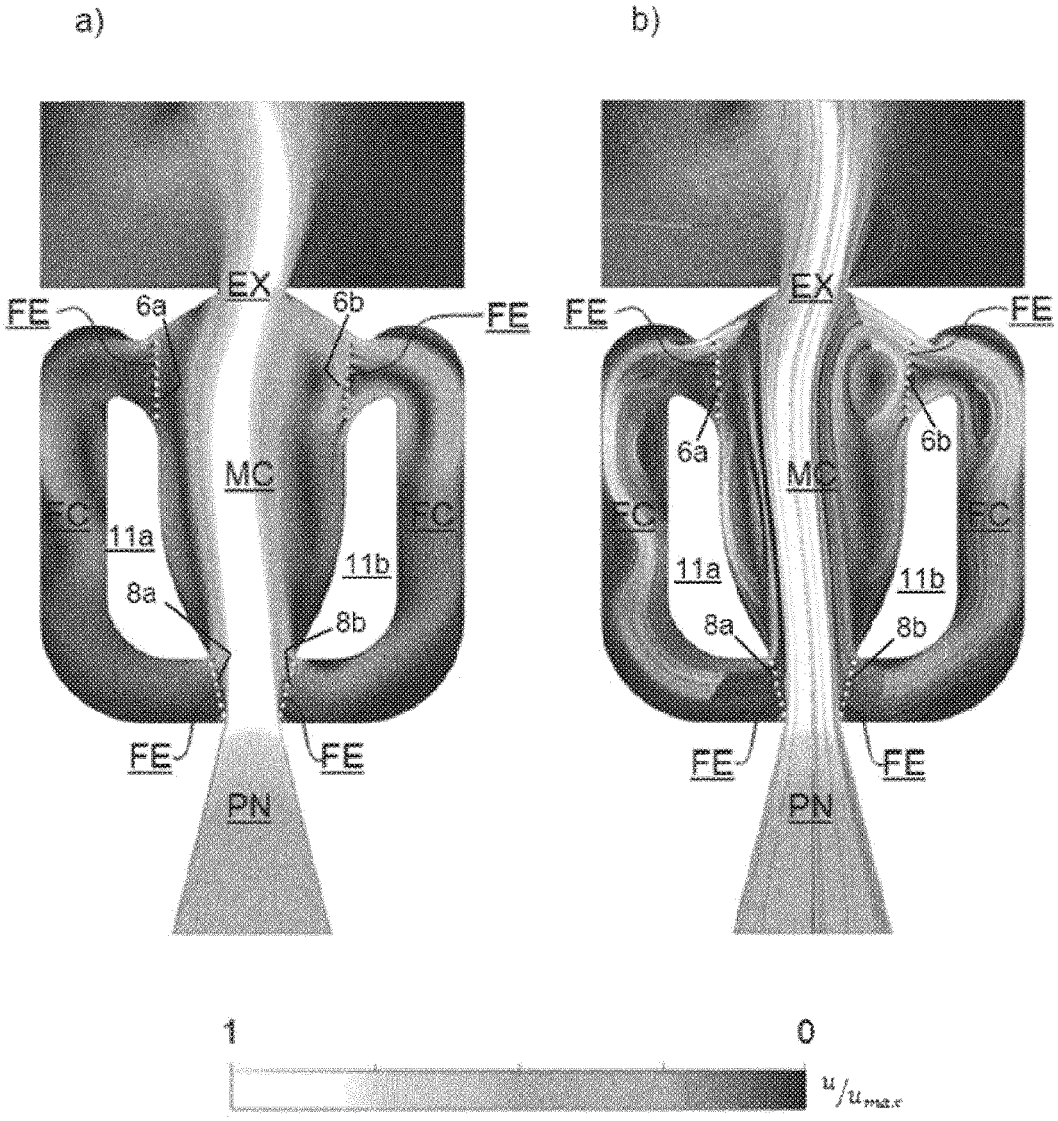
FIG. 3 shows a flow simulation for the fluidic component of FIG. 4, wherein in sub-image a) the velocity distribution and in sub-image b) the velocity distribution and the flow lines are shown.
Figure 4:
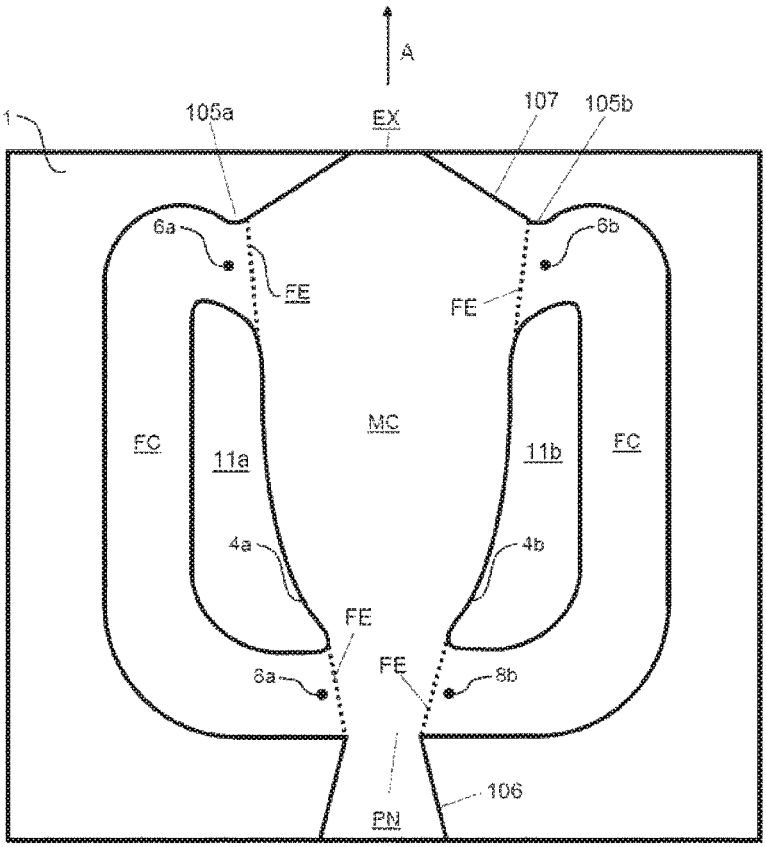
FIG. 4 shows a schematic representation of a fluidic component according to an embodiment of the invention.

FIG. 4 shows a fluidic component 1 according to an embodiment of the invention. In sub-image a), FIG. 3 shows the velocity distribution of a fluid stream which traverses the fluidic component 1 of FIG. 4. In sub-image b) of FIG. 3 the flow lines of the fluid stream are shown in addition.

Figure 7:
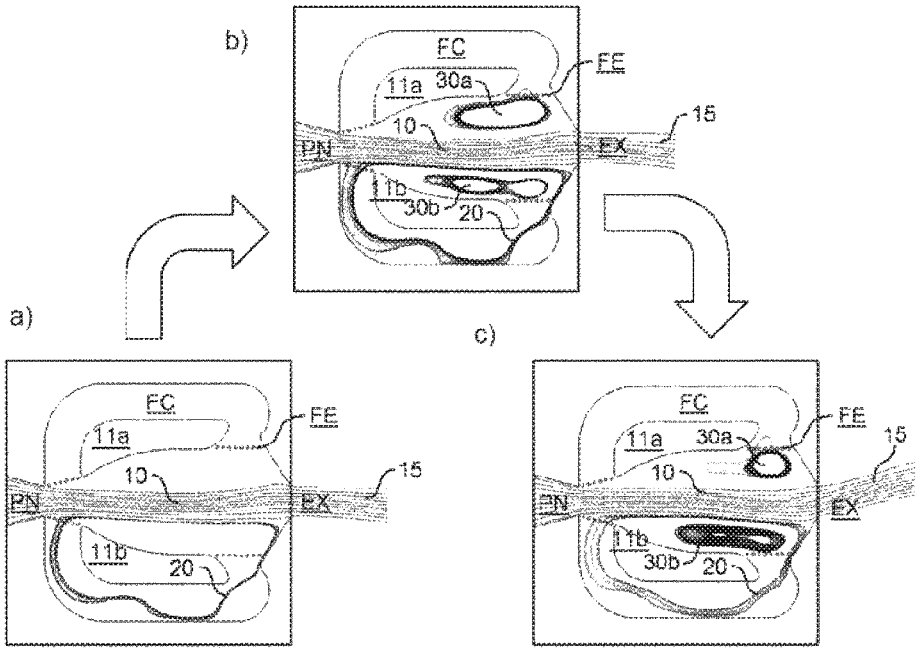
FIG. 7 shows three snapshots (images a) to c)) within an oscillation cycle of a fluid stream to illustrate the position of the filter elements of the fluidic component of FIG. 4 with respect to the main flow, the secondary flow and the recirculation areas.
Figure 20:
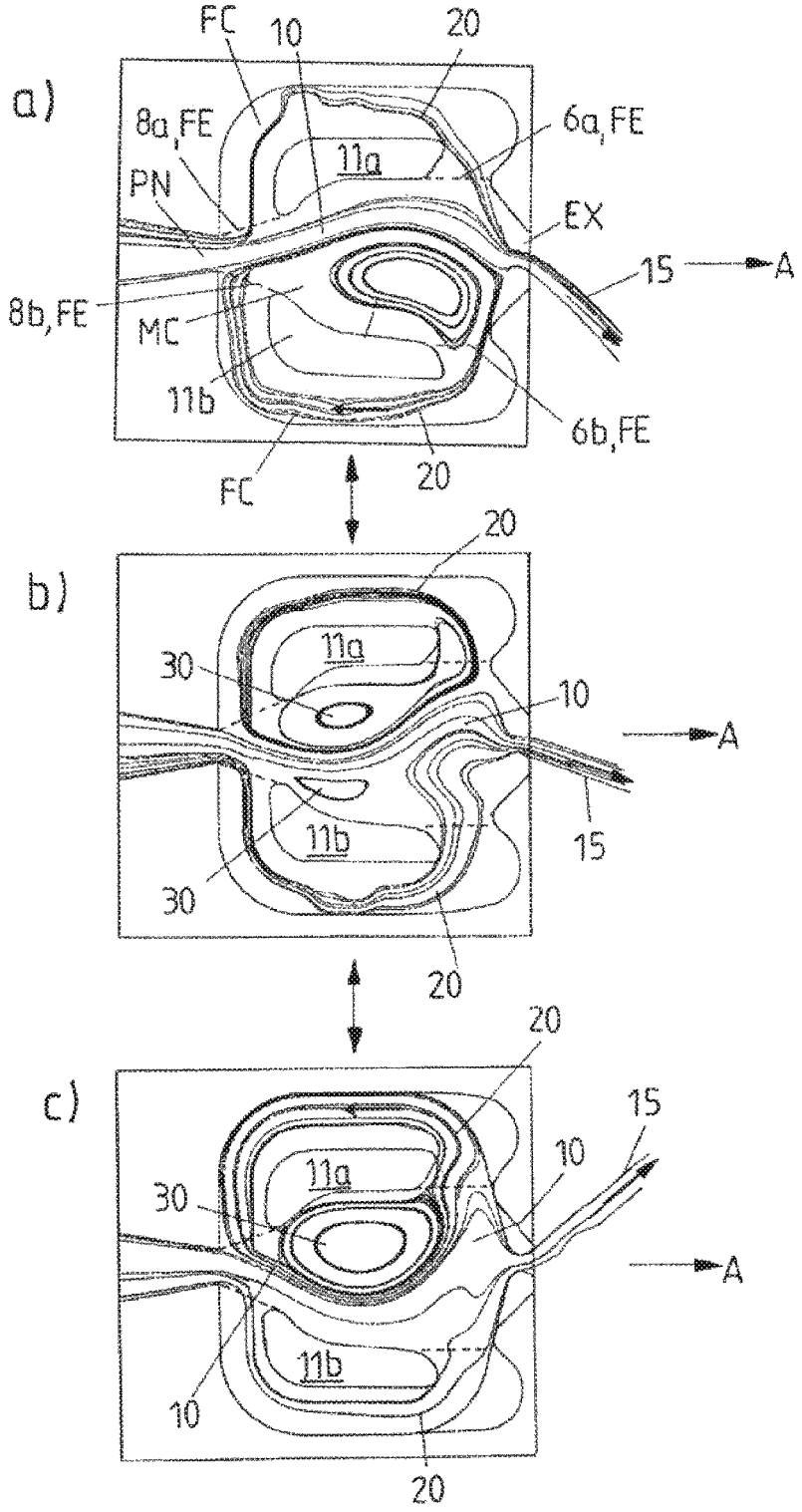
FIG. 20 shows three snapshots (images a) to c)) of an oscillation cycle of a fluid stream to illustrate the flow direction of the fluid stream which flows through the fluidic component of FIG. 4.

The fluidic component 1 of FIG. 4 comprises a flow chamber MC which can be traversed by a fluid stream 10, 20 (FIGS. 3, 7 and 20). The flow chamber MC also is referred to as interaction chamber.

The flow chamber MC comprises an inlet opening PN via which the fluid stream enters into the flow chamber MC, and an outlet opening EX via which the fluid stream exits from the flow chamber MC. The inlet opening PN and the outlet opening EX are arranged on two opposite sides of the fluidic component 1. In the flow chamber MC the fluid stream substantially moves along a longitudinal axis A of the fluidic component 1 (which connects the inlet opening PN and the outlet opening EX with each other) from the inlet opening PN to the outlet opening EX.

The longitudinal axis A forms an axis of symmetry of the fluidic component 1. The longitudinal axis A is the intersection line of two planes of symmetry vertical to each other, with respect to which the fluidic component 1 is mirror-symmetrical. One of the planes of symmetry is parallel to the drawing plane of FIG. 4. Alternatively, the geometry of the fluidic component 1 cannot be of the symmetrical (mirror-symmetrical) or axially symmetrical type.

For the targeted change in direction of the fluid stream, two secondary flow channels (feedback channels) FC are provided beside the flow chamber MC, wherein the flow chamber MC (as seen transversely to the longitudinal axis A) is arranged between the two secondary flow channels FC. Alternatively, only one secondary flow channel or more than two secondary flow channels can also be provided. Directly behind (downstream of) the inlet opening PN the two secondary flow channels FC branch off from the flow chamber MC. Directly before (upstream of) the outlet opening EX, they are then joined again.

The two secondary flow channels FC are symmetrically arranged with respect to the longitudinal axis A. According to a non-illustrated alternative, the secondary flow channels are not arranged symmetrically.

The flow chamber MC substantially linearly connects the inlet opening PN and the outlet opening EX with each other, so that the fluid stream flows substantially along the longitudinal axis A of the fluidic component 1. In a first portion, the secondary flow channels FC extend in opposite directions proceeding from the inlet opening PN each initially at an angle of substantially 90° to the longitudinal axis A. Subsequently, the secondary flow channels FC turn off, so that they each extend (second portion) substantially parallel to the longitudinal axis A (in direction of the outlet opening EX). To again join the secondary flow channels FC and the flow chamber MC, the secondary flow channels FC at the end of the second portion again change their direction, so that they are each directed substantially in direction of the longitudinal axis A (third portion). In the embodiment of FIG. 4, the direction of the secondary flow channels FC changes by an angle of about 120° on transition from the second into the third portion. However, for the change in direction other angles than the one mentioned here can also be chosen between these two portions of the secondary flow channels FC.

The secondary flow channels FC are a means for influencing the direction of the fluid stream which flows through the flow chamber MC. The secondary flow channels FC therefor each include an inlet 6*a*, 6*b* which is formed by the end of the secondary flow channels FC facing the outlet opening EX, and each an outlet 8*a*, 8*b* which is formed by the end of the secondary flow channels FC facing the inlet opening PN. Through the inlets 6*a*, 6*b* a small part of the fluid stream, the secondary flow 20 (FIG. 20), flows into the secondary flow channels FC. The remaining part of the fluid stream (the so-called main flow 10) exits from the fluidic component 1 via the outlet opening EX (FIG. 20). In FIG. 20, the exiting fluid stream is designated with the reference numeral 15. At the outlets 8*a*, 8*b* the secondary flows 20 exit from the secondary flow channels FC, where they can exert a lateral (transversely to the longitudinal axis A) impulse on the fluid stream entering through the inlet opening PN. The direction of the fluid stream is influenced such that the fluid stream 15 exiting at the outlet opening EX spatially oscillates, namely in the plane in which the flow chamber MC and the secondary flow channels FC are arranged. FIG. 20, which shows the oscillating fluid stream, will be explained in detail later on.

The secondary flow channels FC each have a cross-sectional area which is almost constant along the entire length (from the inlet 6*a*, 6*b* to the outlet 8*a*, 8*b*) of the secondary flow channels FC. On the other hand, the size of the cross-sectional area of the flow chamber MC steadily increases in flow direction of the main flow 10 (i.e. in the direction from the inlet opening PN to the outlet opening EX), wherein the shape of the flow chamber MC is mirror-symmetrical to the two planes of symmetry.

The flow chamber MC is separated from each secondary flow channel FC by a block 11*a*, 11*b*. In the embodiment of FIG. 4, the two blocks 11*a*, 11*b* are identical in shape and size and are arranged symmetrically with respect to the longitudinal axis A. In principle, however, they can also be formed differently and be aligned non-symmetrically. In the case of a non-symmetrical alignment the shape of the flow chamber MC also is non-symmetrical. The shape of the blocks 11*a*, 11*b*, which is shown in FIG. 4, only is an example and can be varied. The blocks 11*a*, 11*b* of FIG. 4 have rounded edges.

At the inlet 6*a*, 6*b* of the secondary flow channels FC there are also provided separators 105*a*, 105*b* in the form of indentations. At the inlet 6*a*, 6*b* of each secondary flow channel FC an indentation 105*a*, 105*b* each protrudes beyond a portion of the circumferential edge of the secondary flow channel FC into the respective secondary flow channel FC and at this point changes its cross-sectional shape by reducing the cross-sectional area. In the embodiment of FIG. 4 the portion of the circumferential edge is chosen such that each indentation 105*a*, 105*b* (among other things also) is directed to the inlet opening PN (aligned substantially parallel to the longitudinal axis A). Alternatively, the separators 105*a*, 105*b* can be oriented differently. The separation of the secondary flows 20 from the main flow 10 is influenced and controlled by the separators 105*a*, 105*b*. By the shape, size and orientation of the separators 105*a*, 105*b* the quantity which flows from the fluid stream into the secondary flow channels FC as well as the direction of the secondary flows 20 can be influenced. This in turn leads to an influence on the exit angle of the exiting fluid stream 15 at the outlet opening EX of the fluidic component 1 (and hence to an influence on the oscillation angle) as well as the frequency at which the exiting fluid stream 15 oscillates at the outlet opening EX. By choosing the size, orientation and/or shape of the separators 105*a*, 105*b* the profile of the fluid stream 15 exiting at the outlet opening EX thus can be influenced in a targeted way. Alternatively, a separator can also be provided only at the inlet of one of the two secondary flow channels.

Upstream of the inlet opening PN a funnel-shaped attachment 106 is provided, which tapers in direction of the inlet opening PN (downstream). The flow chamber MC also tapers, namely in the region of the outlet opening EX. The taper is formed by an outlet channel 107 which extends between the separators 105*a*, 105*b* and the outlet opening EX. The funnel-shaped attachment 106 and the outlet channel 107 taper such that only their width (i.e. their extension in the drawing plane in FIG. 4 vertically to the longitudinal axis A) each decreases in downstream direction. The taper has no influence on the depth (i.e. the extension vertically to the drawing plane in FIG. 4) of the attachment 106 and of the outlet channel 107. Alternatively, the attachment 106 and the outlet channel 107 also can each taper in terms of width and depth. Furthermore, only the attachment 106 can taper in terms of depth or width, while the outlet channel 107 tapers both in terms of width and in terms of depth, and vice versa. The extent of the taper of the outlet channel 107 influences the directional characteristic of the fluid stream 15 exiting from the outlet opening EX and thus its oscillation angle. In FIG. 4, the shape of the funnel-shaped attachment 106 and the outlet channel 107 only are shown by way of example. Here, their width each decreases linearly in downstream direction. Other shapes of the taper are possible.

In the region of the inlets 6*a*, 6*b* and the outlets 8*a*, 8*b* of the secondary flow channels FC filter elements FE each are arranged. In the region of the inlets 6*a*, 6*b* the filter elements FE extend before the separators 105*a*, 105*b* as seen in flow direction of the secondary flows. In FIG. 4 broken lines are depicted schematically, which indicate a substantially linear arrangement of individual filter elements FE in each inlet and outlet region 6*a*, 6*b*, 8*a*, 8*b*. Not every point of the broken lines necessarily corresponds to a filter element FE. Rather, the broken lines merely show the basic course (linear in the exemplary embodiment of FIG. 4) of the filter elements FE. The filter elements FE extend over the entire component depth. The filter elements FE are arranged at a distance from the blocks 11*a*, 11*b* and from the side walls of the flow chamber MC and the secondary flow channels FC. A filter element assembly (a group of filter elements) extends across the entire width of the secondary flow channels FC, but can also be less broad. The filter element assemblies extend substantially transversely (which does not necessarily mean an angle of 90°) to the flow direction of the secondary flows 20. The shape, size and number of the filter elements FE can be chosen according to various criteria. For example, the type of the fluid as well as the quantity, shape and size of the particles with which the fluid is loaded can influence the shape, size and number of the filter elements FE. Preferably, the distance between the filter elements FE in the inlet regions 6*a*, 6*b* is smaller than the distance between the filter elements FE in the outlet regions 8*a*, 8*b*. Alternatively, the filter elements FE only are provided in the inlet regions 6*a*, 6*b* and not in the outlet regions 8*a*, 8*b*.

The filter elements FE can be positioned according to a mental continuation of the lateral walls 4*a*, 4*b* of the blocks 11*a*, 11*b* (or of the flow chamber MC). In contrast to the illustrated filter position, the filter elements FE also can be positioned along the streamlines obtained in the flow situation in which the main flow attaches to one of the lateral walls 4*a*, 4*b* of the blocks 11*a*, 11*b* (or of the flow chamber MC). Furthermore, the filter elements FE can be arranged in the region of the inlet 6*a*, 6*b* of the secondary flow channel FC and/or in the region of the outlet 8*a*, 8*b* of the secondary flow channel FC at a position in which the largest flow velocity components (of the main flow) occur, which alternately are located along and transversely to the main flow. The skilled person can determine this position by means of the usual methods known from the prior art for a fluidic component without filter elements. It is also possible to position the filter elements FE in the region of the narrowest cross-section of the secondary flow channels FC. In fluidic components with a separator 105*a*, 105*b* this position frequently is located between the separator 105*a*, 105*b* and the block 11*a*, 11*b* which separates the flow chamber from the secondary flow channel FC.

FIG. 20 shows three snapshots of a fluid stream to illustrate the flow direction (streamlines) of the fluid stream in the fluidic component 1 of FIG. 4 during an oscillation cycle (images a) to c)). In the images a) and c) the streamlines are shown for two deflections of the exiting fluid stream 15, which approximately correspond to the maximum deflections. The angle swept by the exiting fluid stream 15 between these two maxima is the oscillation angle α (FIG. 20). Image b) shows the streamlines for a position of the exiting fluid stream 15, which approximately lies in the middle between the two maxima of images a) and c). In the following, the flows within the fluidic component 1 during an oscillation cycle will be described. There will be used the terms "upper secondary flow channel" and "lower secondary flow channel". The same merely relate to the relative arrangement of the two secondary flow channels in FIG. 4 (not to a necessarily required arrangement) and serve the better understanding.

First of all, the pressurized fluid stream is conducted into the fluidic component 1 via the inlet opening PN. In the region of the inlet opening PN the fluid stream hardly experiences a pressure loss, as it can flow into the flow chamber MC undisturbed. The main flow 10 of the fluid stream initially flows along the longitudinal axis A in direction of the outlet opening EX (image a)).

By introducing a one-time accidental or targeted disturbance, the fluid stream is deflected laterally in direction of the side wall of the one block 11*a* facing the flow chamber MC, so that the direction of the fluid stream increasingly deviates from the longitudinal axis A, until the fluid stream is maximally deflected. Due to the so-called Coanda effect, the largest part of the fluid stream, the so-called main flow 10, attaches to the side wall of the one block 11*a* and then flows along this side wall. In the region between the main flow 10 and the other block 11*b* a recirculation area 30 is formed. The recirculation area 30 grows, the more the main flow 10 attaches to the side wall of the one block 11*a*. The main flow 10 exits from the outlet opening EX at an angle changing over time with respect to the longitudinal axis A. In FIG. 20*a*) the main flow 10 attaches to the side wall of the one block 11*a* and the recirculation area 30 facing the block 11*b* has its maximum size. In addition, the fluid stream 15 exits from the outlet opening EX with approximately the largest possible deflection.

A small part of the fluid stream, the so-called secondary flow 20, separates from the main flow 10 and flows into the secondary flow channels FC via their inlets 6*a*, 6*b*. In the situation shown in FIG. 20*a*) the part of the fluid stream, which flows into the secondary flow channel FC adjoining the block 11*b* to whose side wall the main stream 10 does not attach, is distinctly larger (due to the deflection of the fluid stream in direction of the block 11*a*) than the part of the fluid stream which flows into the secondary flow channel FC adjoining the block 11*a*, to whose side wall the main flow 10 attaches. In FIG. 20*a*) the secondary flow 20 in the upper secondary flow channel FC hence is distinctly larger than the secondary flow 20 in the lower secondary flow channel FC, which almost is negligible. In general, the deflection of the fluid stream into the secondary flow channels FC can be influenced and controlled by means of separators. The secondary flows 20 (in particular the secondary flow 20 in the lower secondary flow channel FC) flow through the secondary flow channels FC to their respective outlets 8*a*, 8*b* and hence provide an impulse to the fluid stream entering at the inlet opening PN. As the secondary flow 20 in the lower secondary flow channel FC is larger than the secondary flow 20 in the upper secondary flow channel FC, the impulse component resulting from the secondary flow 20 in the lower secondary flow channel FC is predominant.

The main flow 10 hence is pressed against the side wall of the block 11*a* due to the impulse (of the secondary flow 20 in the lower secondary flow channel FC). At the same time, the recirculation area 30 facing the block 11*b* moves in direction of the inlet 8*b* of the lower secondary flow channel FC, whereby the supply of fluid into the lower secondary flow channel FC is disturbed. The impulse component resulting from the secondary flow 20 in the lower secondary flow channel FC hence decreases. At the same time, the recirculation area 30 facing the block 11*b* is reduced in size, while a further (growing) recirculation area 30 is formed between the main flow 10 and the side wall of the block 11*a*. The supply of fluid into the upper secondary flow channel FC also increases. The impulse component resulting from the secondary flow 20 in the upper secondary flow channel FC hence increases. The impulse components of the secondary flows 20 in the further course more and more approach each other, until they are of equal size and cancel each other out. In this situation the entering fluid stream is not deflected, so that the main flow 10 moves approximately centrally between the two blocks 11*a*, 11*b* and a fluid stream 15 exits from the outlet opening EX almost without deflection. FIG. 20*b*) does not show exactly this situation, but a situation shortly before the same.

In the further course, the supply of fluid into the upper secondary flow channel FC increases more and more, so that the impulse component resulting from the secondary flow 20 in the upper secondary flow channel FC exceeds the impulse component resulting from the secondary flow 20 in the lower secondary flow channel FC. The main flow 10 thereby is urged away more and more from the side wall of the block 11*a*, until it attaches to the side wall of the opposed block 11*b* due to the Coanda effect (FIG. 20*c*)). The recirculation area 30 which faces the block 11*b* thereby is dissolved, while the recirculation area 30 which faces the block 11*a* grows to its maximum size. The main flow 10 now exits from the outlet opening EX with maximum deflection, which as compared to the situation of FIG. 20*a*) has an inverse sign.

Subsequently, the recirculation area 30 which faces the block 11*a* will travel and block the inlet 6*a* of the upper secondary flow channel FC, so that the supply of fluid here decreases again. In the following the secondary flow 20 in the lower secondary flow channel FC will provide the dominant impulse component, so that the main flow 10 again is pressed away from the side wall of the block 11*b*. The described changes now take place in reverse order.

Due to the construction of the fluidic component and the described process, the fluid stream 15 exiting at the outlet opening EX oscillates about the longitudinal axis A in a plane in which the flow chamber MC and the secondary flow channels FC are arranged, so that a fluid jet cyclically sweeping to and fro is generated. To achieve the described effect, a symmetrical construction of the fluidic component 1 is not absolutely necessary.

FIG. 3 in the sub-images a) and b) each shows a snapshot of the transient flow process within the fluidic component 1 of FIG. 4, wherein in both sub-images the time of taking the shot is the same. The velocity of the fluid stream within the fluidic component is coded by grey scales. The velocity field within the fluidic component represents the normalized velocity of the fluid stream in main flow direction (from the inlet opening PN to the outlet opening EX) with the maximum velocity in main flow direction. The color black corresponds to the normalized velocity $u/u_{max}$ 0 and the color white corresponds to the normalized velocity $u/u_{max}$ 1 and thus to the maximum velocity in main flow direction.

In sub-image b) of FIG. 3 flow lines also are shown for additional visualization. Between the outlet opening EX and the filter elements FE at the inlet 6*b* of the secondary flow channel FC on the right in FIG. 3*a* region can be seen, where a streamline forms a closed curve (recirculation area). In this current flow situation, transverse forces act on the filter elements FE or the flow here has high transverse components with respect to the main flow direction. Due to the oscillation mechanism, the recirculation area shown in FIG. 3 is dissolved, wherein another recirculation area is obtained between the outlet opening EX and the filter elements FE at the inlet 6*a* of the secondary flow channel FC on the left in FIG. 3. Due to this dynamic the individual filter elements FE alternately are approached transversely with respect to the main flow direction. This flow situation ensures that particles possibly adhering to a filter element FE again are conveyed in direction of the main flow and then are entrained by the main flow. The self-cleaning effect of the fluidic component can be achieved thereby.

In sub-images a) to c) FIG. 7 shows three snapshots during an oscillation cycle. Not all streamlines are shown here, but only streamlines with high flow velocity. In principle, the filter elements FE can be cleaned by the main flow 10 (at the inlet 6*a*, 6*b*), the secondary flow 20 (at the outlet 8*a*, 8*b*) and by the constantly changing recirculation areas (30 (at the inlet 6*a*, 6*b*). Sub-images b) and c) by way of example show how recirculation areas 30 move along the filter elements FE at the inlet 6*a*, 6*b* of the feedback channels FC and in doing so change their shape. A filtered foreign object experiences a force acting on the same from different directions. This force can ensure that the foreign object again is released and is then discharged by the main flow 10 or by the recirculation area 30 itself. Foreign objects which are filtered at the outlet 8*a*, 8*b* of the feedback channels FC can be removed by the secondary flow 20, which exits from the feedback channel FC. Therefore, a larger distance of the filter elements FE can be provided in the outlet region 8*a*, 8*b* than in the inlet region 6*a*, 6*b*, so that foreign objects which could flow through the filter elements FE in the inlet region 6*a*, 6*b* also can leave the feedback channel FC.

The fluidic component of FIG. 4 can also be regarded as fluidic oscillator, wherein the (one-time) targeted change in direction of the main flow 10 leads to an oscillation of the main flow 10 in the flow chamber MC and of the exiting fluid stream 15. The fluidic component 1 of FIG. 4 cannot lose its function despite particles or foreign objects with which the fluid traversing the fluidic component 1 is loaded. Another positive side effect consists in that the pressure loss in the fluidic component of FIG. 4 is smaller as compared to the known fluidic components with filter elements FE, which are located near the inlet region PN (FIGS. 1 and 2), as in the known construction the entire fluid stream must flow through the filter elements FE.

By the filter elements FE a cross-sectional constriction can be created at the inlet 6*a*, 6*b* of the feedback channels FC and/or at the outlet 8*a*, 8*b* of the feedback channels FC. The filter elements hence can be formed by individual bodies spaced from each other, whereby a reduction of the cross-section of the feedback channels FC is generated, in order to achieve a filter function. The individual (filter) bodies can have a distance to each other which is not so small that no more fluid can get through and/or not so large that no more filter effect is achieved. By the filter elements FE in the region of the feedback channels FC it is prevented that a larger amount of particles or foreign objects can penetrate into the feedback channels FC. Thus, the deposition of foreign objects in the feedback channels FC is reduced or prevented. This risk of the deposition in the feedback channels FC would exist without the filter elements, as the flow velocity in a feedback channel FC mostly is considerably smaller than the flow velocity in the flow chamber MC. The foreign objects thus might settle in the feedback channels and might not be flushed away.

By an arrangement of the filter elements FE for example in the region of a flow with a periodic change in direction, the fluid can clean the filter elements FE on its own. By a recirculation area 30 (at the inlet of a secondary flow channel) and/or by the secondary flow 20 (at the outlet of the secondary flow channel) the particles or deposits are released from the filter element FE, which can then be transported away with the main flow 10.

Figure 5:
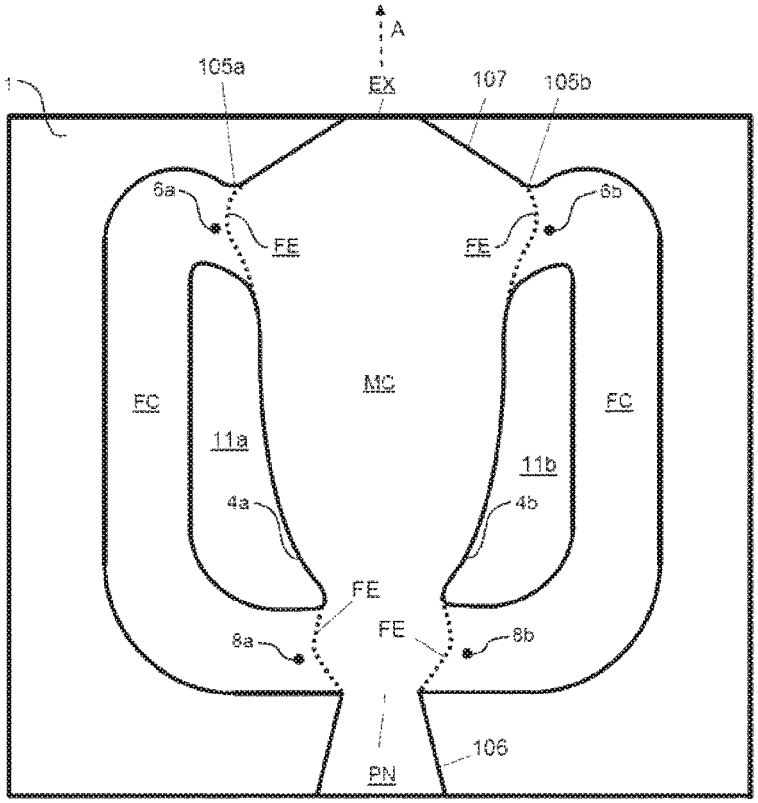
FIG. 5 shows a schematic representation of a fluidic component according to a further embodiment of the invention.

The fluidic component 1 of FIG. 5 differs from that of FIG. 4 in particular by the arrangement of the filter elements FE. Here as well, filter elements FE each are arranged in the region of the inlets 6*a*, 6*b* and the outlets 8*a*, 8*b* of the secondary flow channels FC. However, the filter elements FE in FIG. 5 are not arranged in a straight line (linearly), but each follow a curved path (broken lines in FIG. 5). The path at the two inlets 6*a*, 6*b* and at the two outlets 8*a*, 8*b* each is mirror-symmetrical, wherein the path at the inlets 6*a*, 6*b* differs from the path at the outlets 8*a*, 8*b*. The filter elements FE at the inlets 6*a*, 6*b* as seen in flow direction of the secondary flows 20 (i.e. in direction from an inlet 6*a*, 6*b* to the corresponding outlet 8*a*, 8*b*) are arranged according to a concave curvature, and the filter elements FE at the outlets 8*a*, 8*b* as seen in flow direction of the secondary flows 20 are arranged according to a convex curvature. The radii of curvature of the convex and the concave curvature are different and in FIG. 5 only shown by way of example. Depending on the case of application (type of fluid (for example viscosity, density, surface tension, temperature), type (size, shape, deformability) and quantity of the particles) the radii of curvature can be chosen differently. For example, at both inlets 6*a*, 6*b* and at both outlets 8*a*, 8*b* the radii of curvature can be identical or each be different (for example in the case of a non-symmetrical design of the fluidic component). Moreover, all curvatures can be convex or concave.

Figure 6:
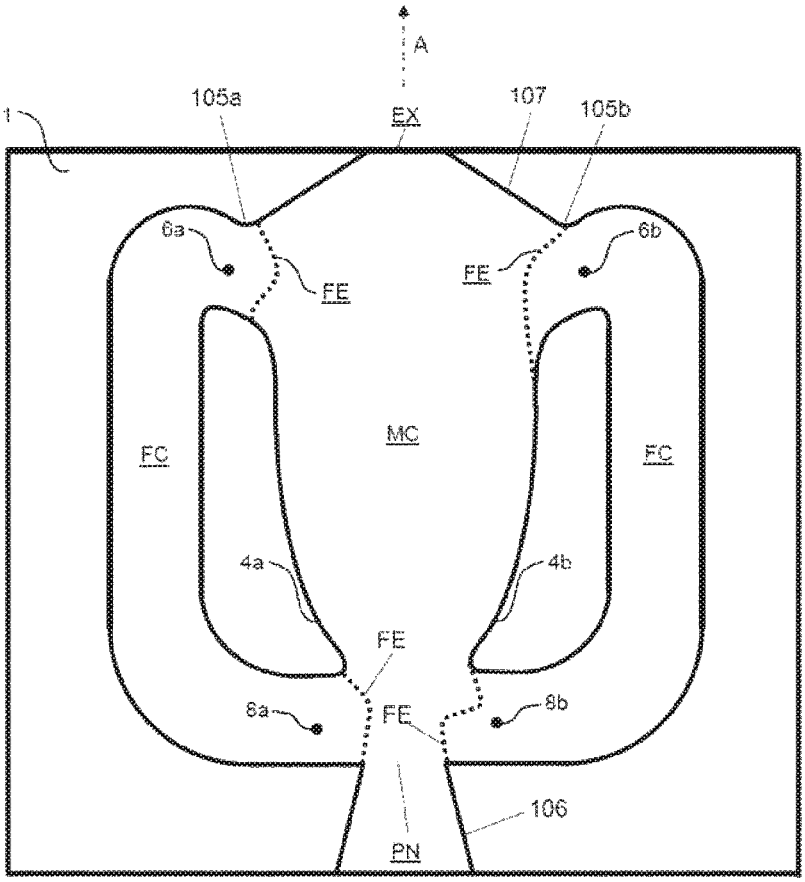
FIG. 6 shows a schematic representation of a fluidic component according to a further embodiment of the invention.

FIG. 6 shows further examples for the course of the filter elements FE. The fluidic component 1 of FIG. 6 likewise differs from the one of FIG. 4 in particular by the arrangement of the filter elements FE. The filter elements FE at the inlets 6*a*, 6*b* as seen in flow direction of the secondary flows 20 (i.e. in direction from an inlet 6*a*, 6*b* to the corresponding outlet 8*a*, 8*b*) each are arranged according to a convex curvature, wherein the two convex curvatures however differ from each other. As seen in flow direction of the secondary flows 20, the filter elements FE at the outlet 8*a* are arranged according to a concave curvature. The filter elements FE at the outlet 8*b* are arranged according to a zigzag line. Further geometries for the arrangement of the filter elements FE are imaginable. Depending on the case of application (type of fluid (for example viscosity, density, surface tension, temperature), type (size, shape, deformability) and quantity of the particles) different geometries can be chosen. The geometry for the arrangement of the filter elements FE for example is chosen such that the filter elements FE extend along the streamlines of the fluid stream.

Figure 8:
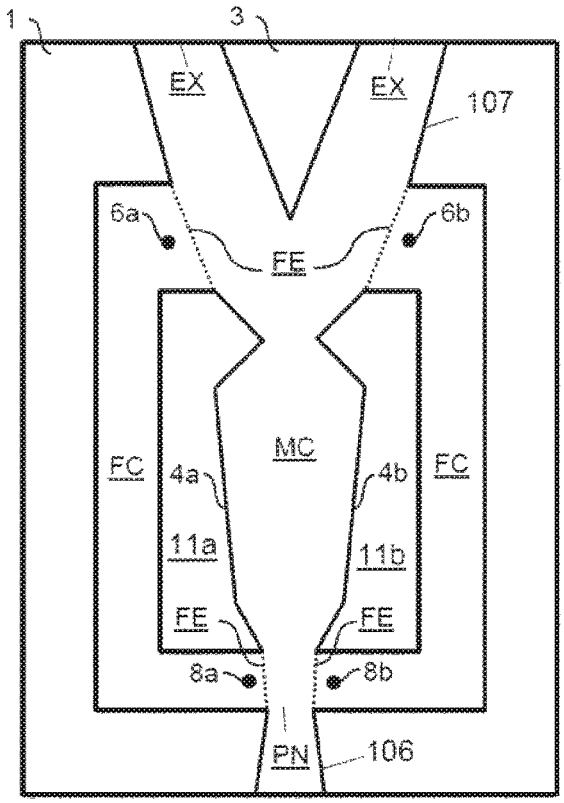
FIG. 8 shows a schematic representation of a fluidic component according to a further embodiment of the invention.
Figure 10:
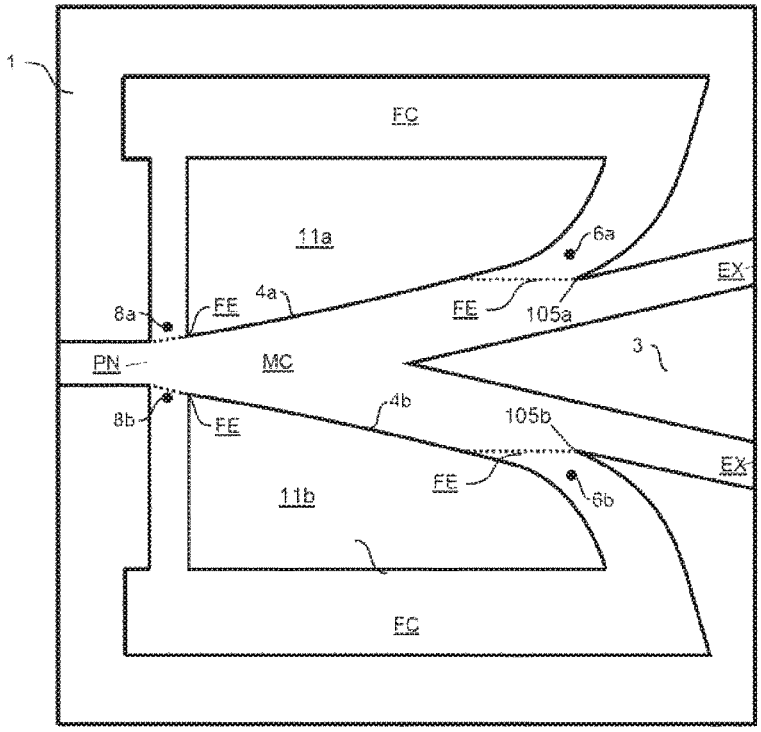
FIG. 10 shows a schematic representation of a fluidic component according to a further embodiment of the invention.

FIGS. 8 and 10 show two more embodiments of the fluidic component 1. These two embodiments differ from that of FIG. 4 in particular by the fact that in the outlet channel 107*a* flow divider (also called splitter) 3 is provided. At the inlets 6*a*, 6*b* of the secondary flow channels FC of the fluidic component 1 of FIG. 8 no separator is provided. In FIG. 10, the separators 105*a*, 105*b* (as compared to the embodiment of FIG. 4) have a shape pointed in direction of the inlet opening PN. The shape of the blocks 11*a*, 11*b* also is different from the shape as shown in FIG. 4. The basic geometrical properties of these two embodiments however correspond with those of the fluidic component 1 of FIG. 4.

The flow divider 3 each has the shape of a triangular wedge which broadens in fluid flow direction. The outlet channel 107 also broadens in fluid flow direction. The wedge has a depth which corresponds to the component depth. (The component depth is constant over the entire fluidic component 1). The flow divider 3 hence divides the outlet channel 107 in two sub-channels with two outlet openings EX and the fluid stream in two sub-streams which exit from the fluidic component 1. Due to the oscillation mechanism described in connection with FIG. 4, the two sub-streams exit from the two outlet openings EX in a pulsed manner.

In the embodiment of FIG. 8, the flow divider 3 substantially extends in the outlet channel 107, whereas in the embodiment of FIG. 10 it protrudes into the flow chamber MC. In principle, the shape and size of the flow divider 3 can freely be chosen depending on the desired application. There can also be provided several flow dividers (transversely to the longitudinal axis A in the oscillation plane or also transversely to the oscillation plane of the fluid stream), in order to divide the exiting fluid jet into more than two sub-streams.

FIGS. 8 and 10 also show two more embodiments for the blocks 11*a*, 11*b*. However, these shapes only are to be understood by way of example and not exclusively in connection with the flow divider 3. When using a flow divider 3, the blocks 11*a*, 11*b* also can be formed differently. The blocks 11*a*, 11*b* of FIG. 8 have a substantially trapezoidal basic shape, which tapers in downstream direction (in its width) and from whose ends a triangular protrusion each projects into the flow chamber MC. The blocks 11*a*, 11*b* of FIG. 10 resemble those of FIG. 4, but have no rounded corners.

In FIGS. 8 and 10 (like also in FIG. 4) the filter elements FE are arranged along a straight line (broken line) in the region of the inlets 6*a*, 6*b* and the outlets 8*a*, 8*b* of the secondary flow channels FC.

Figure 9:
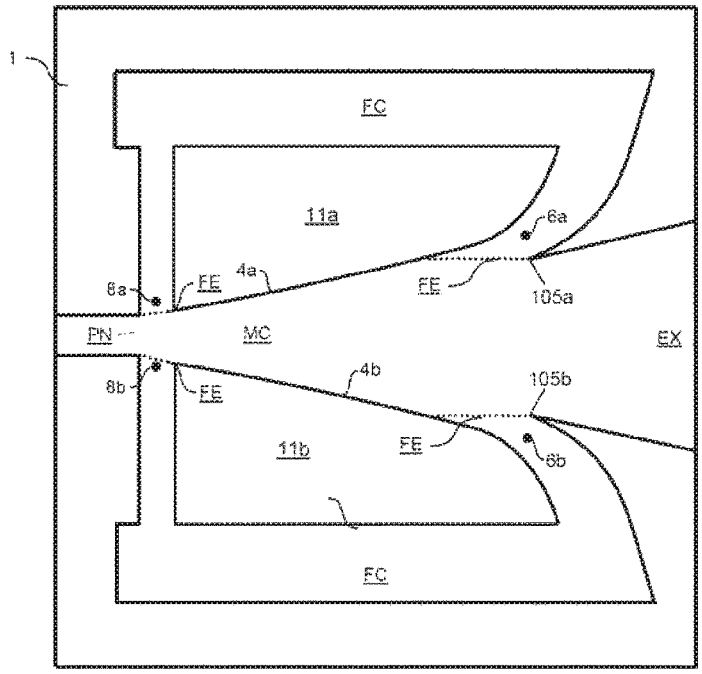
FIG. 9 shows a schematic representation of a fluidic component according to a further embodiment of the invention.

The fluidic component of FIG. 9 corresponds to the one of FIG. 10 and in particular differs from the latter in that no flow divider is provided.

Figure 11:
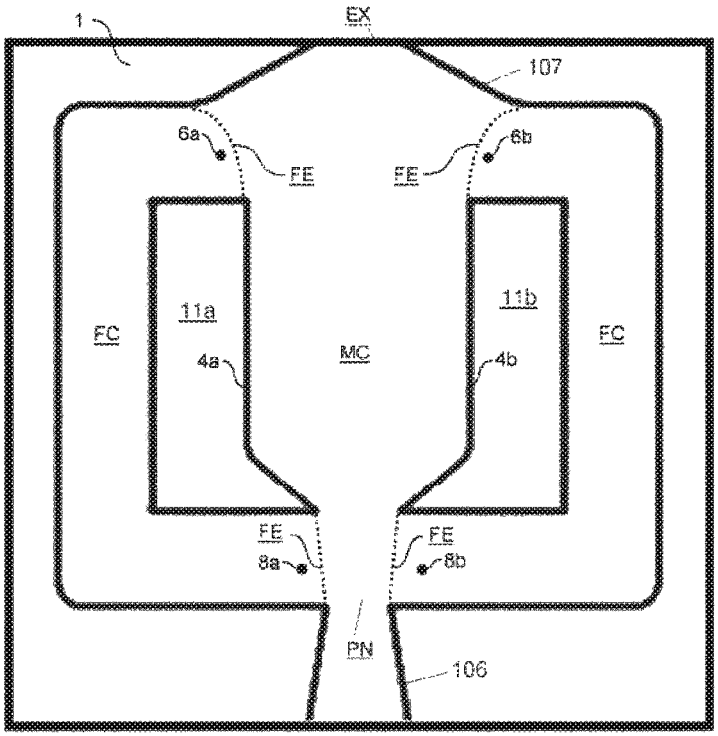
FIG. 11 shows a schematic representation of a fluidic component according to a further embodiment of the invention.
Figure 12:
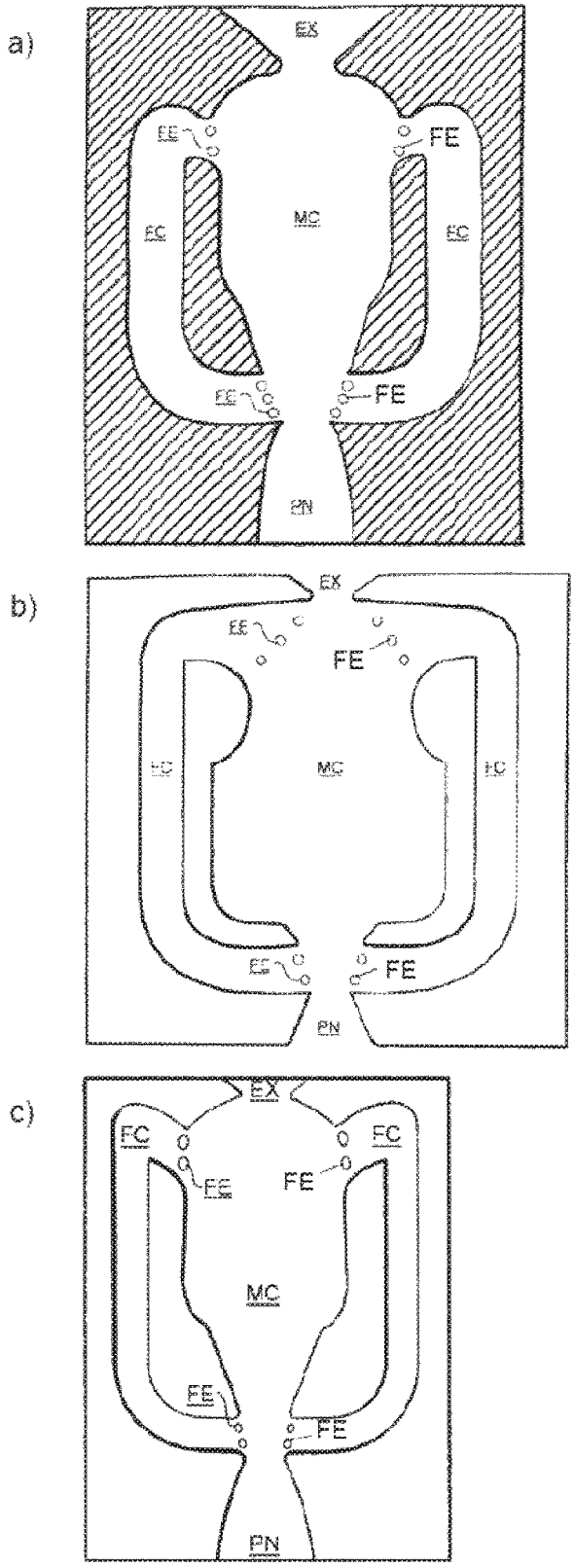
FIG. 12 shows three schematic representations of fluidic components according to further embodiments of the invention.
Figure 13:
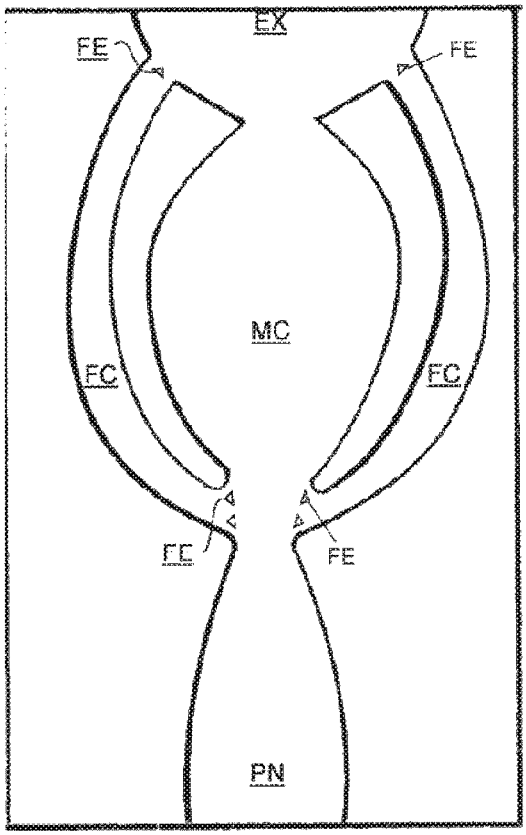
FIG. 13 shows a schematic representation of a fluidic component according to a further embodiment of the invention.
Figure 14:
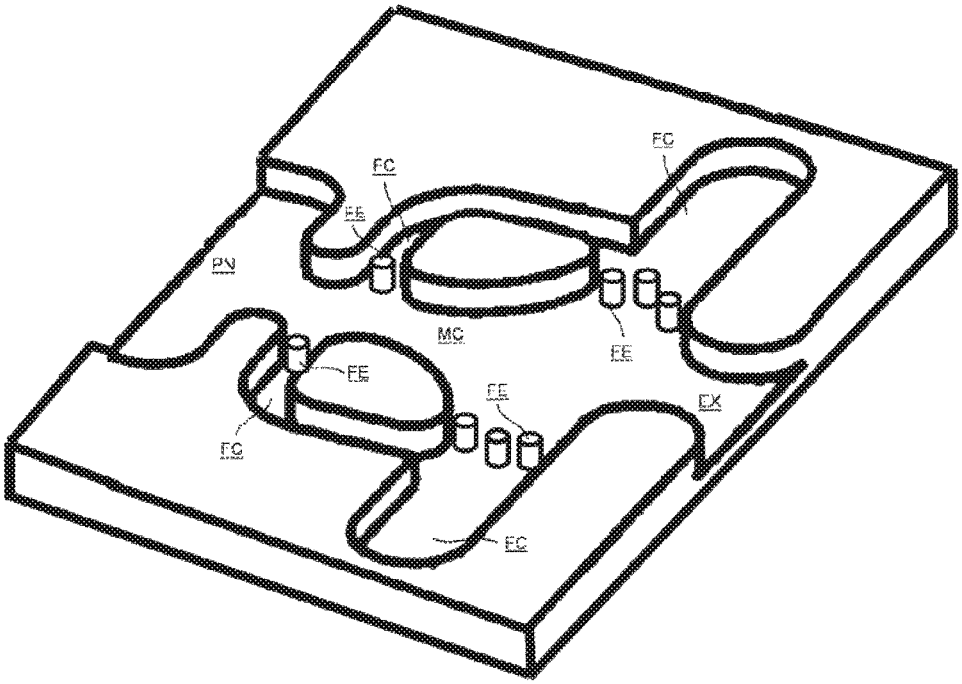
FIG. 14 shows a schematic representation of a fluidic component according to a further embodiment of the invention.

Another embodiment of the invention is shown in FIG. 11. In this embodiment, the secondary flow channels FC are separated from the flow chamber MC by the blocks 11*a*, 11*b*, wherein the blocks 11*a*, 11*b* are substantially rectangular and each include a triangular protrusion which at the end of the blocks 11*a*, 11*b* facing the inlet opening PN projects into the flow chamber MC. Hence, the flow chamber (with the exception of the region in which the triangular protrusions are formed) has a substantially constant width. Due to the shape of the blocks 11*a*, 11*b* the individual portions of the secondary flow channels FC extend substantially parallel or vertically to the flow chamber MC. Separators are not provided in the embodiment of FIG. 11. In the region of the inlets 6*a*, 6*b* of the secondary flow channels FC filter elements FE are provided, which each are arranged along a curved line. As see in flow direction of the secondary flows 20 (i.e. in direction from an inlet 6*a*, 6*b* to the corresponding outlet 8*a*, 8*b*) the line is arranged according to a convex curvature. In the region of the outlets 8*a*, 8*b* of the secondary flow channels FC filter elements FE are provided, which each are arranged along a straight line. The filter element assemblies extend substantially transversely (which does not necessarily mean an angle of 90°) to the flow direction of the secondary flows 20.

Figure 15:
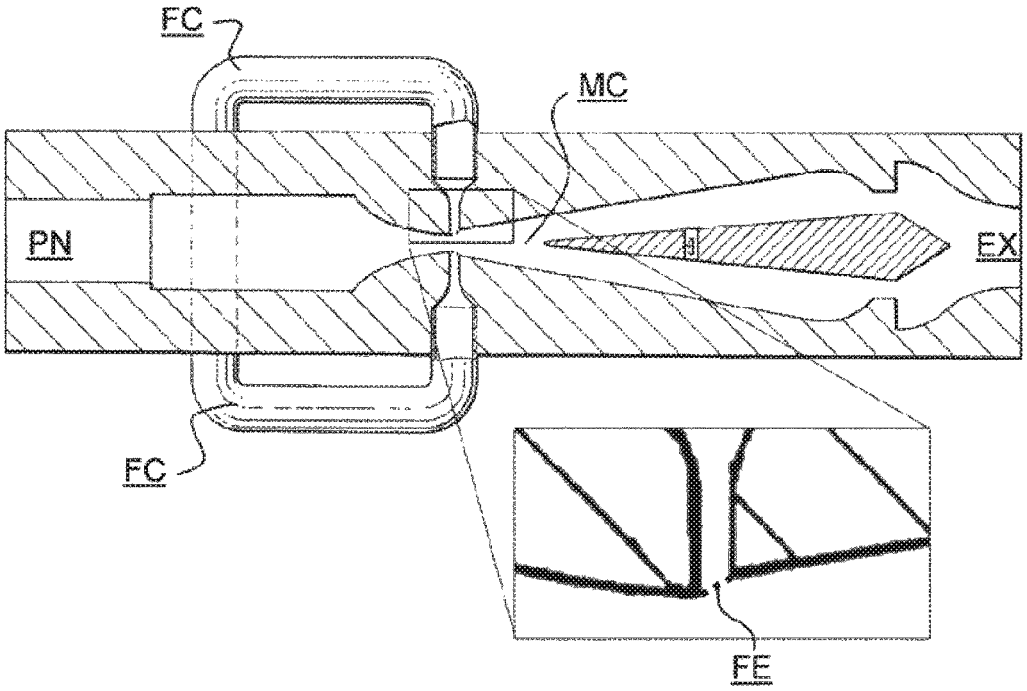
FIG. 15 shows a schematic representation of a fluidic component according to a further embodiment of the invention.
Figure 16:
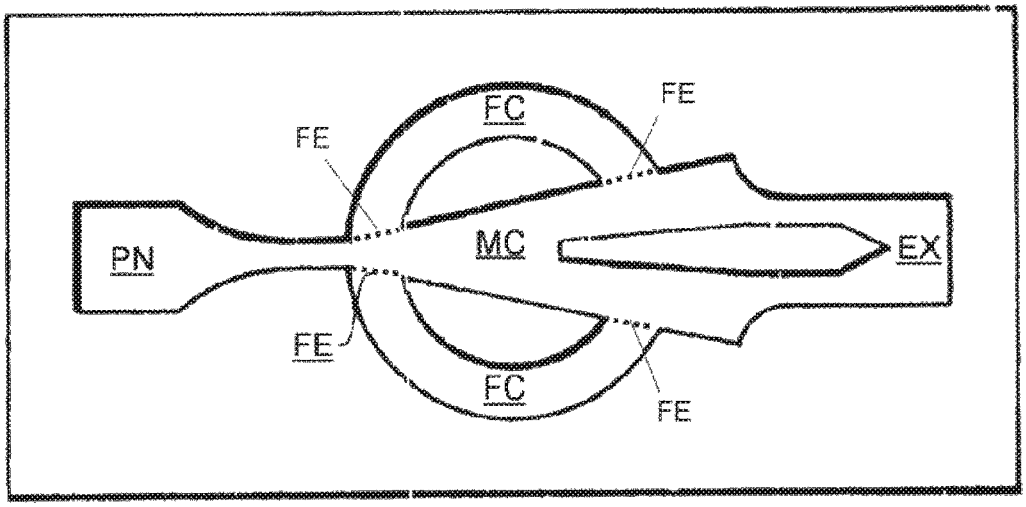
FIG. 16 shows a schematic representation of a fluidic component according to a further embodiment of the invention.

In FIGS. 12 to 19 various known fluidic components are shown, which additionally include filter elements FE. According to the invention, the filter elements FE are arranged at the inlets and outlets of the secondary flow channels FC (FIGS. 12-17, 19). In FIG. 15, the secondary flow channel FC is short-circuited. Thus, an opening of the secondary flow channel acts as inlet and outlet in temporal alternation. In a first step, the upper opening of the secondary flow channel FC shown in FIG. 15 for example is an inlet, and thus the lower opening of the secondary flow channel FC shown in FIG. 15 is an outlet, namely until the (main) flow is pressed onto the other wall side of the flow chamber MC. Thereafter, the respective openings swap their function.

Figure 17:
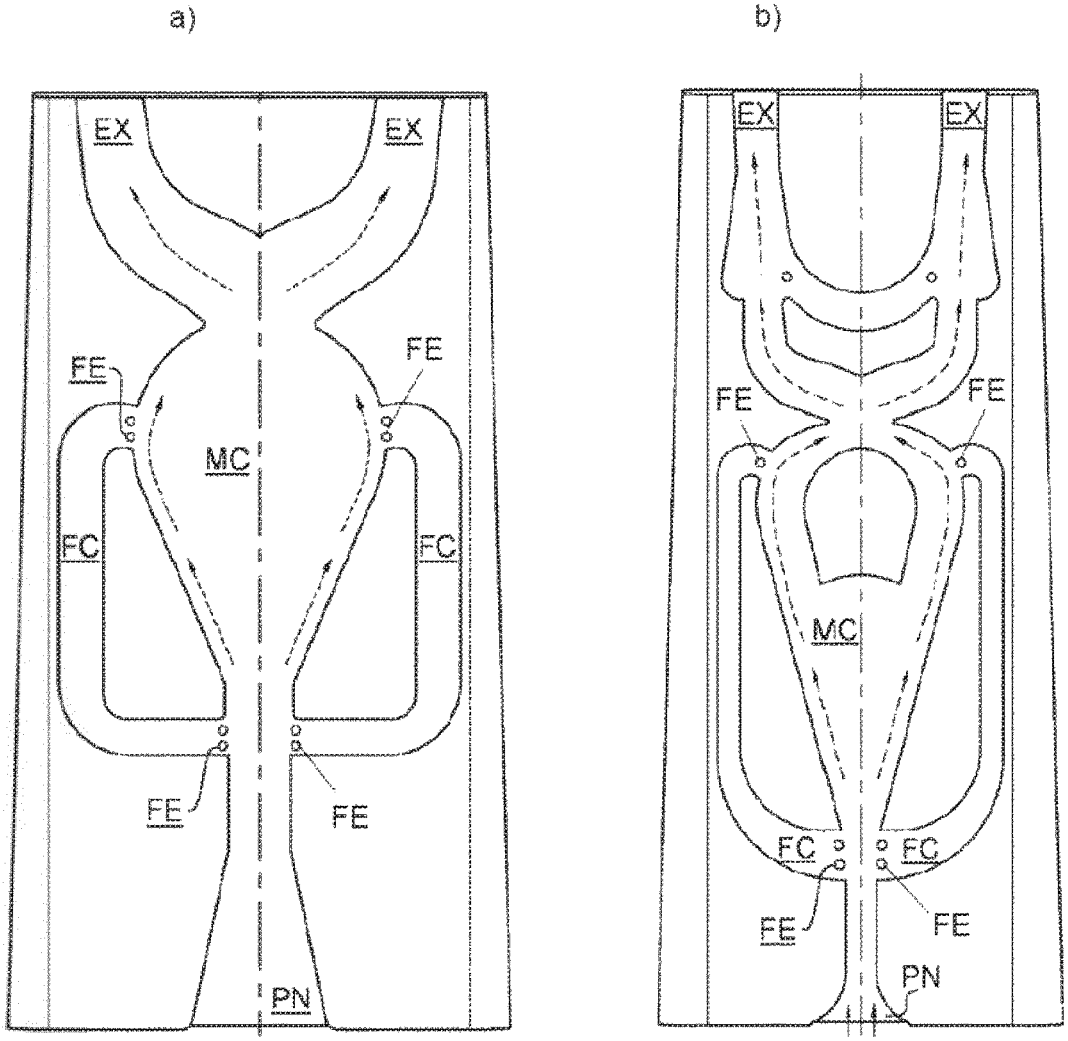
FIG. 17 shows two schematic representations of fluidic components according to further embodiments of the invention.

In FIG. 17, sub-image b), several feedback channels FC are provided. The feedback channel FC in the region of the outlet opening EX intensifies the temporal pulsation, but here does not act as a means for changing the main flow direction. The filter elements FE secure the function of the additional feedback channel FC.

Figure 18:
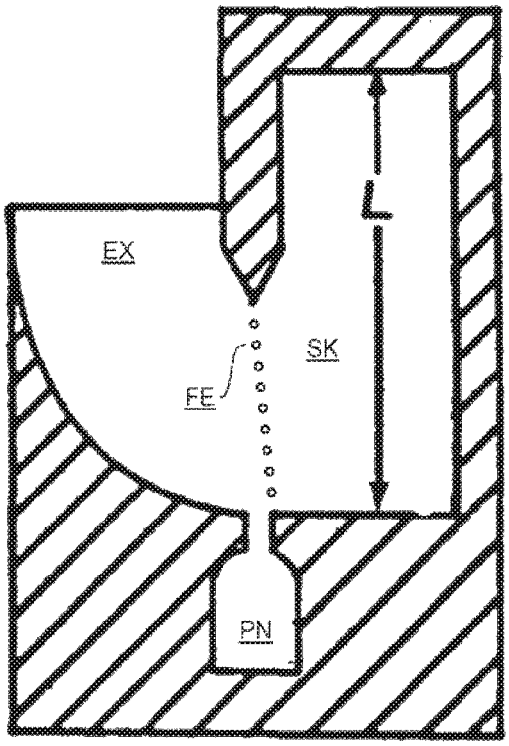
FIG. 18 shows a schematic representation of a fluidic component according to a further embodiment of the invention.
Figure 19:
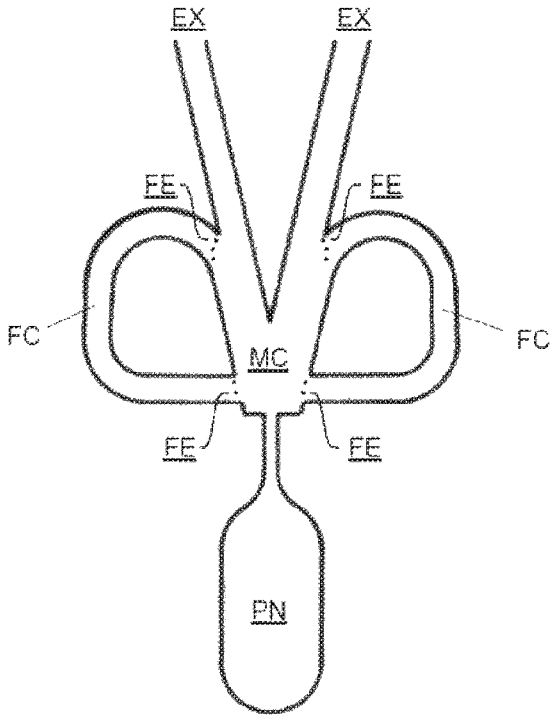
FIG. 19 shows a schematic representation of a fluidic component according to a further embodiment of the invention.

In FIG. 18 a closed cavity SK is provided as means for the targeted change in direction of the main flow. In this exemplary embodiment the inlet of the closed cavity SK at the same time is the outlet of the closed cavity SK. The filter elements FE are arranged in the inlet/outlet region of the closed cavity SK.

The fluidic components of FIGS. 12 to 19 without filter elements (or with filter elements in the region/downstream of the inlet opening of the fluidic components) are known from the following disclosures: EP 1 053 059 B1 (FIG. 12, sub-images a) and b)), WO 80/00927 (FIG. 12, sub-image c), FIG. 13), EP 1 658 209 B1 (FIG. 14), DE 2 051 804 (FIG. 15), DE 2 414 970 (FIG. 16), U.S. Pat. No. 8,733,401 B2 (FIG. 17, sub-images a) and b)), Review of some fluid oscillators, Harry Diamond Laboratories, Washington, 1969 (FIG. 18), A review of Fluidic Oscillator Development and Application for Flow Control, 43rd Fluid Dynamic Conference, 24-27 Jun. 2013.

The fluidic component (1) according to the invention is suitable for fluids loaded or contaminated with particles or foreign objects, wherein despite the particles or foreign objects, which penetrate into the fluidic component, it maintains its function (formation of an oscillating fluid stream) and is not clogged by the particles. The fluidic component (1) according to the invention additionally has a self-cleaning effect, as the filter elements are again flushed free by the (pressurized) fluid. Thus, the filter elements FE can be cleaned by the main flow 10, the secondary flow 20 and by the constantly changing recirculation areas 30. The changing direction of the main flow 10 and in particular of the recirculation areas 30 during the oscillation process correspondingly rinses and cleans the filter elements FE. A filtered foreign object thus experiences a force acting from different directions. This force can ensure that the foreign object again is released and is then discharged by the main flow 10 or by a recirculation area 30. This effect is pronounced very much in particular at the inlet 6*a*, 6*b* of the feedback channels FC (cf. FIG. 7). Foreign objects which are filtered in the outlet region 8*a*, 8*b* of the feedback channels FC can be removed by the secondary flow 20.

The presence of the filter elements only causes a minor pressure loss, as in essence only the secondary flow must flow through the cross-sectional constriction. The fluidic component has an increased service life, as the integrated filter elements (and the secondary flow channels or closed cavities) are not clogged. Furthermore, due to the arrangement of the filter elements according to the invention the costs and complexity are reduced as compared to systems with upstream filter systems (arranged upstream of the inlet opening of the fluidic components).

The fluidic component according to the invention is suitable for every field of application working with fluids. For example, the fluidic component according to the invention can be used for the cleaning technology. Another field of application is surface wetting, the surface treatment or the change of the surface finish by powder coating or by particle collision with the surface. Typical methods therefor include blasting methods, such as shot peening. The fluidic component according to the invention can, however, also be used in fields of application dealing with fiber-containing fluids, such as in the paper industry.

For all embodiments of the invention the following applies: The filter elements FE can serve to influence the spray characteristic of the exiting fluid stream (exit angle of the exiting fluid stream, oscillation frequency of the exiting fluid stream). The spacing of the filter elements in the individual inlet and/or outlet regions of the means for the targeted change in direction of the main flow may be the same, but also different. For example, the distance of the filter elements FE at the inlet 6*a*, 6*b* of a feedback channel FC can be smaller than the distance between the filter elements FE which are located at the outlet 8*a*, 8*b* of this feedback channel FC. The geometry of the fluidic components in principle can be designed freely. The invention is applicable to all fluidic components which include at least one feedback channel FC or a closed cavity.

REFERENCE NUMERALS

1 fluidic component
3 flow divider (splitter)
4 lateral wall of the flow chamber
6*a*, 6*b* inlet of feedback channel
8*a*, 8*b* outlet of feedback channel
10 main flow
11*a*, 11*b* block
15 fluid jet at outlet opening
20 secondary flow
30 recirculation area
105*a*, 105*b* separator
106 funnel-shaped attachment
107 outlet channel
EX outlet opening
FC feedback channel (secondary flow channel), means for the targeted change in direction of the main flow
FE filter elements
MC flow chamber
PN inlet opening

The invention claimed is:

1. A fluidic component, comprising:

a) a flow chamber with at least one inlet opening and at least one outlet opening, wherein the flow chamber can be traversed by a main flow of a fluid from the at least one inlet opening to the at least one outlet opening, b) at least one deflection device for the targeted change in direction of the main flow, and at least one filter element between the at least one deflection device for the targeted change in direction of the main flow and the flow chamber, wherein the at least one filter element is arranged downstream of the inlet opening of the flow chamber, so that only a part of the fluid stream passes the at least one filter element, wherein the at least one filter element is arranged along or parallel to one of several streamlines of the main flow, wherein each streamline represents a flow direction, and wherein the at least one filter element is arranged in a region of the fluid stream along or parallel to a streamline of the main flow, in which as compared to other streamlines or regions the main flow at least temporarily has a large flow velocity component substantially along and/or perpendicular to a basic direction of the main flow.

2. The fluidic component according to claim 1, wherein the at least one deflection device for the targeted change in direction of the main flow includes a feedback channel, is formed as feedback channel or is formed as a closed cavity.

3. The fluidic component according to claim 1, wherein in operation the at least one filter element between the flow chamber and the at least one deflection device for the targeted change in direction of the main flow is exposed to a flow with changing flow direction.

4. The fluidic component according to claim 1, wherein the at least one filter element is arranged at a position between the flow chamber and the at least one deflection device for the targeted change in direction of the main flow, at which the fluid changes its flow velocity transversely to the main flow maximally.

5. The fluidic component according to claim 1, wherein the at least one filter element is arranged at a position between the flow chamber and the at least one deflection device for the targeted change in direction of the main flow, at which the cross-section, which is effective for the flow, of the flow chamber or of the at least one deflection device for the targeted change in direction of the main flow is minimal.

6. The fluidic component according to claim 1, wherein the at least one filter element is arranged at an opening of the at least one deflection device for the targeted change in direction of the main flow.

7. The fluidic component according to claim 1, wherein the at least one filter element is arranged in a mental continuation of a portion of the flow chamber at a position between the flow chamber and the at least one deflection device for the targeted change in direction of the main flow.

8. The fluidic component according to claim 1, wherein the at least one filter element is formed cylindrical, conical, rectangular, triangular, pyramid-shaped, oval-shaped, round or polygonal.

9. The fluidic component according to claim 1, wherein the at least one filter element includes a lattice structure and/or a net.

10. The fluidic component according to claim 1, wherein in operation the at least one filter element is subject to a self-cleaning effect due to a changing flow direction.

11. The fluidic component according to claim 1, comprising a non-stick coating.

12. The fluidic component according to claim 1, wherein the at least one filter element is formed at least partly flexible and/or elastically deformable.

13. An apparatus with a fluidic component according to claim 1, wherein the apparatus is at least one of the following apparatuses:

a household appliance / industrial appliance or commercial appliance comprising:
- a rinsing machine;
- a dishwashing appliance;
- a washing machine;
- a steam cleaning appliance;
- a steam cooker;
- a convection oven;
- a pasteurizing system;
- a tumble dryer;
- an appliance with steam function;
- a sterilizing system; or
- a disinfection system;

a cleaning appliance comprising:
- a high-pressure cleaner;
- a low-pressure cleaner;
- a washing line;
- a spray cleaning system;
- a descaling system; or
- a de-icing system;

an irrigation device comprising:
- agriculture and agricultural technology; or
- a distribution of plant protection agents;

a blasting technology device comprising:
- a shot peening method;
- a $CO_2$, snow or dry ice blasting;
- a blasting with mineral media; or
- a compressed-air blasting;

a surface treatment device comprising:
- a painting facility; or
- an electroplating facility;

a whirlpool;

a mixing system comprising:
- a combustion device;
- an internal combustion engine;
- a heating system;
- an injection system;
- a mixing facility; or
- a bio/chemical reactor;

a cooling system;

an extinguishing system; or a water treatment system.

14. The fluidic component according to claim 1, wherein the at least one deflection device for the targeted change in direction of the main flow is a deflection device for generating a varying approach flow direction for the main flow and wherein the at least one filter element is arranged between the at least one deflection device for generating a varying approach flow direction for the main flow and the flow chamber.

15. The fluidic component according to claim 1, wherein the at least one deflection device for the targeted change in direction of the main flow is configured to effect a periodic reversal of the main flow.

16. The fluidic component according to claim 6, wherein the at least one filter element is arranged only at an inlet, only at an outlet, or at the inlet and the outlet of the at least one deflection device for the targeted change in direction of the main flow.

17. The fluidic component according to claim 11, wherein the non-stick coating is on the at least one filter element.

* * * * *